US011300309B2

(12) United States Patent
Yanachi et al.

(10) Patent No.: US 11,300,309 B2
(45) Date of Patent: Apr. 12, 2022

(54) AIR CONDITIONING APPARATUS

(71) Applicant: Mitsubishi Electric Corporation, Tokyo (JP)

(72) Inventors: Satoru Yanachi, Tokyo (JP); So Nomoto, Tokyo (JP); Takuya Matsuda, Tokyo (JP); Naofumi Takenaka, Tokyo (JP); Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/976,573

(22) PCT Filed: May 2, 2018

(86) PCT No.: PCT/JP2018/017523

§ 371 (c)(1),
(2) Date: Aug. 28, 2020

(87) PCT Pub. No.: WO2019/211905

PCT Pub. Date: Nov. 7, 2019

(65) Prior Publication Data

US 2021/0003306 A1 Jan. 7, 2021

(51) Int. Cl.

| | |
|---|---|
| ***F24F 11/36*** | (2018.01) |
| ***F24F 11/38*** | (2018.01) |
| ***F25B 49/00*** | (2006.01) |

(52) U.S. Cl.

CPC ..... *F24F 11/36* (2018.01); *F24F 11/38* (2018.01); *F25B 49/005* (2013.01); *F25B 2313/0231* (2013.01)

(58) Field of Classification Search

CPC .. F24F 11/36; F24F 11/38; F24F 11/84; F25B 2313/0231; F25B 2313/003

See application file for complete search history.

(56) References Cited

U.S. PATENT DOCUMENTS 5,241,833 A * 9/1993 Ohkoshi ..... F24F 11/00 62/126
6,430,944 B1 * 8/2002 Ozawa ..... F25B 49/005 165/11.1

(Continued)

FOREIGN PATENT DOCUMENTS

JP S56-081329 U 7/1981
JP H04-261672 A 9/1992

(Continued)

OTHER PUBLICATIONS

Office Action dated Jun. 8, 2021, issued in corresponding JP Patent Application No. 2020-516996 ( and English translation).

(Continued)

*Primary Examiner* — Nelson J Nieves
(74) *Attorney, Agent, or Firm* — Posz Law Group, PLC

(57) ABSTRACT

An air conditioning apparatus uses a heat medium containing at least one of cold water and hot water. The air conditioning apparatus includes: a heat source device; a heat exchanger configured to exchange heat between the heat medium and air; a flow rate control valve configured to control a flow rate at which the heat medium is supplied to the heat exchanger; a temperature sensor configured to detect a temperature of the heat medium discharged from the heat exchanger; and a failure determination unit configured to detect presence or absence of an abnormality in a flow path of the heat medium based on the temperature detected by the temperature sensor and a commanded degree of opening for the flow rate control valve.

9 Claims, 14 Drawing Sheets

(56) References Cited

U.S. PATENT DOCUMENTS

| | | | | |
|---|---|---|---|---|
| 2003/0132850 | A1* | 7/2003 | Ozawa | F25D 17/02 340/686.1 |
| 2008/0168783 | A1* | 7/2008 | Kojima | F25D 21/006 62/151 |
| 2011/0302941 | A1 | 12/2011 | Takata | |
| 2014/0305152 | A1* | 10/2014 | Morimoto | F24F 3/06 62/126 |
| 2019/0186777 | A1* | 6/2019 | Kageyama | F24F 11/77 |
| 2019/0195550 | A1* | 6/2019 | Sakae | F25B 13/00 |
| 2019/0316800 | A1* | 10/2019 | Gao | F24F 11/63 |
| 2019/0316820 | A1* | 10/2019 | Zhai | F25B 49/005 |
| 2019/0316821 | A1* | 10/2019 | Zhai | F25B 30/00 |
| 2021/0231319 | A1* | 7/2021 | Rosen | F24F 5/0003 |

FOREIGN PATENT DOCUMENTS

| | | | |
|---|---|---|---|
| JP | 2004-278902 | A | 10/2004 |
| JP | 2008-096002 | A | 4/2008 |
| JP | 2008-249234 | A | 10/2008 |
| JP | 2009-034589 | A | 2/2009 |
| JP | 2011-234594 | A | 11/2011 |
| JP | 2015-224841 | A | 12/2015 |
| WO | 2010/109617 | A1 | 9/2010 |
| WO | 2013/108290 | A1 | 7/2013 |

OTHER PUBLICATIONS

International Search Report of the International Searching Authority dated Jun. 26, 2018 for the corresponding international application No. PCT/JP2018/017523 (and English translation).

European Search Report dated Mar. 31, 2021, issued in corresponding European Patent Application No. 18917441.0.

* cited by examiner

FIG.6

| NUMBER OF INDOOR UNITS WHERE FAILURE HAS BEEN DETECTED | LOCATION OF FAILURE | POSSIBILITY OF OCCURRENCE OF FAILURE | RELATION BETWEEN EXPECTED TEMPERATURE Tj AND OUTLET WATER TEMPERATURE Tout | DETAILS OF FAILURE |
|---|---|---|---|---|
| NOT ALL | MAIN PIPE | NO | – | – |
| | BRANCH PIPE | YES (WATER PASSAGE) | Tj<Tout | LEAKAGE OF HEAT MEDIUM IN BRANCH PIPE CONNECTED TO INDOOR UNIT WHERE FAILURE HAS BEEN DETECTED |
| | FLOW RATE CONTROL VALVE | YES (WATER PASSAGE) | Tj<Tout | FAILURE IN FLOW RATE CONTROL VALVE OF INDOOR UNIT WHERE FAILURE HAS BEEN DETECTED |
| | FAN | YES (AIR PASSAGE) | Tj>Tout | FAILURE IN FAN MOTOR OF INDOOR UNIT WHERE FAILURE HAS BEEN DETECTED (PRESENCE OR ABSENCE OF FAILURE CAN BE DETERMINED ALSO BY MOTOR CURRENT) |
| | FIN | YES (AIR PASSAGE) | Tj>Tout | CLOGGING OF FIN WITH DUST, CORROSION OF FIN OF INDOOR UNIT WHERE FAILURE HAS BEEN DETECTED |
| ALL | MAIN PIPE | YES (WATER PASSAGE) | Tj<Tout | LEAKAGE OF HEAT MEDIUM |
| | BRANCH PIPE | YES (WATER PASSAGE) | Tj<Tout | LEAKAGE OF HEAT MEDIUM IN BRANCH PIPE CONNECTED TO INDOOR UNIT WHERE FAILURE HAS BEEN DETECTED |
| | FLOW RATE CONTROL VALVE | YES (WATER PASSAGE) | Tj<Tout | FAILURE IN FLOW RATE CONTROL VALVE OF INDOOR UNIT WHERE FAILURE HAS BEEN DETECTED |
| | FAN | YES (AIR PASSAGE) | Tj>Tout | FAILURE IN FAN MOTOR OF INDOOR UNIT WHERE FAILURE HAS BEEN DETECTED (PRESENCE OR ABSENCE OF FAILURE CAN BE DETERMINED ALSO BY MOTOR CURRENT) |
| | FIN | YES (AIR PASSAGE) | Tj>Tout | CLOGGING OF FIN WITH DUST, CORROSION OF FIN OF INDOOR UNIT WHERE FAILURE HAS BEEN DETECTED |

AIR CONDITIONING APPARATUS

CROSS REFERENCE TO RELATED APPLICATION

This application is a U.S. national stage application of International Application PCT/JP2018/017523 filed on May 2, 2018, the contents of which are incorporated herein by reference.

TECHNICAL FIELD

The present disclosure relates to an air conditioning apparatus, and more specifically to an air conditioning apparatus using a heat medium containing at least one of cold water and hot water.

BACKGROUND

Conventionally, an indirect air conditioning apparatus is known that generates hot and/or cold water by a heat source device such as a heat pump, and delivers the water to an indoor unit through a water pump and a pipe to perform heating and/or cooling in the interior of a room.

Such an indirect air conditioning apparatus employs water or brine as a use-side heat medium, and thus has been receiving increasing attention in recent years in order to reduce refrigerant usage. Japanese Patent Laying-Open No. 2015-224841 discloses a circulation system capable of suppressing leakage of water of a heat medium from a circulation pipe in such an air conditioning apparatus.

PATENT LITERATURE

PTL 1: Japanese Patent Laying-Open No. 2015-224841

Japanese Patent Laying-Open No. 2015-224841 describes detecting leakage of water by a wire-shaped water leakage detection system in which, when leakage of water occurs, a heat medium permeates through a coating, resulting in a reduction in electrical resistance value. This wire-shaped water leakage detection system is installed on a portion of a circulation pipe where leakage of water is readily sensed when it occurs, such as on a floor surface of a room to be air-conditioned, for example.

However, leakage of water may occur at various locations, and could conceivably occur at a location where the water leakage detection system has not been installed.

SUMMARY

The present disclosure has been made to solve the problem described above, and has an object to provide an air conditioning apparatus using a heat medium containing at least one of cold water and hot water, in which the presence or absence of An air conditioning apparatus of the present disclosure is an air conditioning apparatus using a heat medium containing at least one of cold water and hot water. The air conditioning apparatus includes: a heat source device; a heat exchanger configured to exchange heat between the heat medium and air; a flow rate control valve configured to control a flow rate at which the heat medium is supplied to the heat exchanger; a temperature sensor configured to detect a temperature of the heat medium discharged from the heat exchanger; and a failure determination unit configured to detect presence or absence of an abnormality in a flow path of the heat medium based on the temperature detected by the temperature sensor and a commanded degree of opening for the flow rate control valve.

According to the air conditioning apparatus of the present disclosure, the presence or absence of an abnormality in a flow path of a heat medium can be detected, so that the worsening of a failure or the spread of leakage of water and the like in the air conditioning apparatus can be suppressed.

BRIEF DESCRIPTION OF DRAWINGS

FIG. 6 shows types of failures, and relation between outlet water temperature and expected temperature.

DETAILED DESCRIPTION

Figure 1:
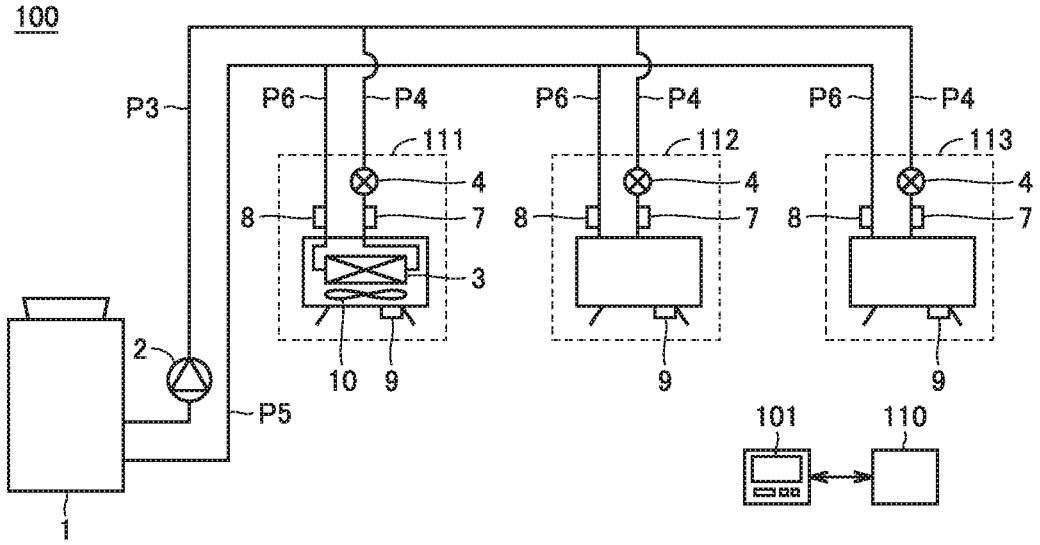
FIG. 1 shows the configuration of an air conditioning apparatus according to a first embodiment.

In the following, embodiments of the present disclosure will be described in detail with reference to the drawings. While a plurality of embodiments are described below, it has been intended from the time of filing of the present application to appropriately combine configurations described in the respective embodiments. Note that the same or corresponding parts are designated by the same characters in the drawings and will not be described repeatedly.

First Embodiment

FIG. 1 shows the configuration of an air conditioning apparatus according to a first embodiment. An air conditioning apparatus 100 is an air conditioning apparatus using a heat medium containing at least one of cold water and hot water. In the following description, the heat medium can be exemplified by water or brine.

Air conditioning apparatus 100 includes a heat source device 1, indoor units 111 to 113, a failure determination unit 110, and a display 101.

Indoor units 111 to 113 each include a heat exchanger 3 for exchanging heat between the heat medium and air, a flow rate control valve 4 for controlling a flow rate at which the heat medium is supplied to heat exchanger 3, temperature sensors 7 to 9, and a fan motor 10 for driving a fan.

Air conditioning apparatus 100 further includes a first pipe (P3 and P4) for delivering the heat medium from heat source device 1 to heat exchanger 3, and a second pipe (P5 and P6) for returning the heat medium from heat exchanger 3 to heat source device 1. The heat medium cooled or heated at heat source device 1 is supplied to indoor units 111 to 113 through the first pipe, and recovered from indoor units 111 to 113 to heat source device 1 through the second pipe.

The first pipe (P3 and P4) includes a third pipe P3 through which the heat medium delivered from heat source device 1 to heat exchangers 3 in indoor units 111 to 113 passes, and a fourth pipe P4 which branches from third pipe P3 and through which the heat medium delivered to each heat exchanger 3 passes. The second pipe (P5 and P6) includes a fifth pipe P5 through which the heat medium returned from heat exchangers 3 in indoor units 111 to 113 to heat source device 1 passes, and a sixth pipe P6 through which the heat medium discharged from each heat exchanger 3 passes, and which joins fifth pipe P5. Instead of or in addition to indoor units 112 to 113, another utilized apparatus (such as a heater or a floor heating system) using hot and/or cold water may be connected to third pipe P3 and fifth pipe P5.

Flow rate control valve 4 is connected between fourth pipe P4 and heat exchanger 3. Flow rate control valve 4 controls a flow rate at which the heat medium is supplied to heat exchanger 3. Note that flow rate control valve 4 may be connected between heat exchanger 3 and sixth pipe P6.

Temperature sensor 7 detects a temperature of the heat medium flowing into heat exchanger 3 from fourth pipe P4. Temperature sensor 8 detects a temperature of the heat medium discharged to sixth pipe P6 from heat exchanger 3. Temperature sensor 9 detects an indoor temperature.

Figure 2:
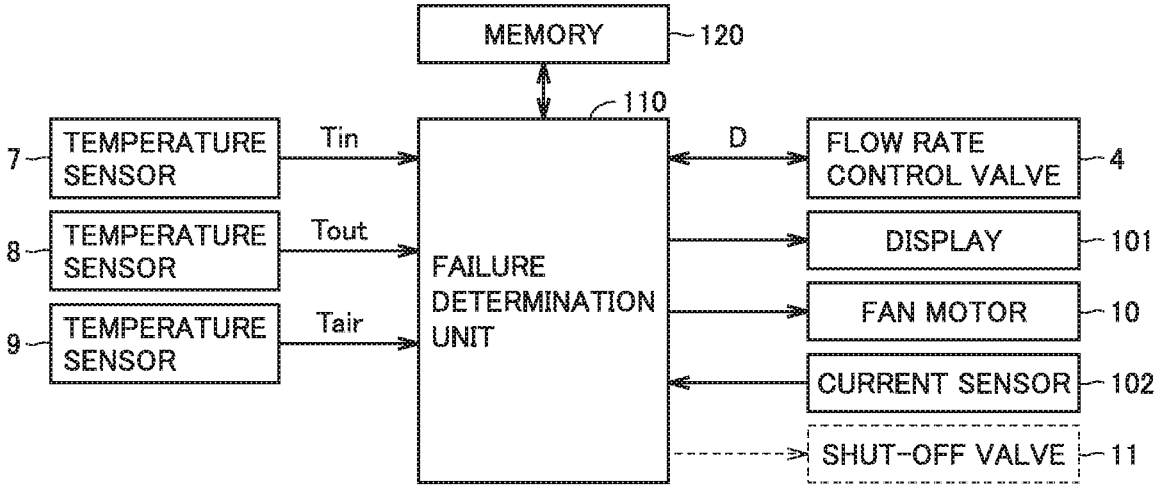
FIG. 2 shows connection relation between a failure determination unit and various sensors and actuators in the first embodiment.

FIG. 2 shows connection relation between the failure determination unit and various sensors and actuators in the first embodiment. Referring to FIGS. 1 and 2, failure determination unit 110 receives an inlet temperature Tin of the heat medium from temperature sensor 7, receives an outlet temperature Tout of the heat medium from temperature sensor 8, and receives an indoor temperature (intake air temperature) Tair from temperature sensor 9.

Failure determination unit 110 also transmits a commanded degree of opening D to flow rate control valve 4, transmits a driving command to fan motor 10, and receives a current value of fan motor 10 from a current sensor 102.

Failure determination unit 110 reads a determination value from a memory 120, and compares the determination value with detected values from the various sensors to make a failure determination. The determination value is determined based on detected values from the various sensors during a certain period of time immediately after installation when a failure has not occurred, and is stored in memory 120.

Based on temperature Tout detected by temperature sensor 8, and commanded degree of opening D for flow rate control valve 4, failure determination unit 110 detects the presence or absence of an abnormality in a flow path of the heat medium. Failure determination unit 110 transmits a determination result to display 101, which in turn displays the determination result. A description will be given of how outlet temperature Tout of the heat medium used for the determination by failure determination unit 110 varies at a normal time.

Figure 3:
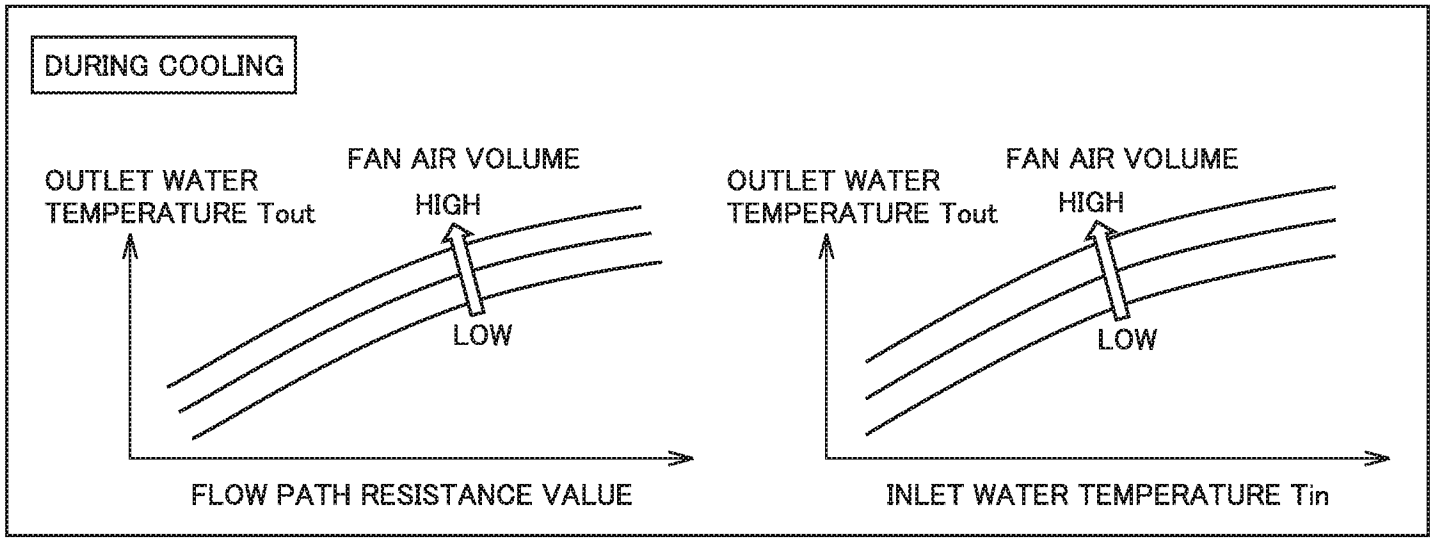
FIG. 3 is a diagram to illustrate variation in outlet temperature of a heat medium.

FIG. 3 is a diagram to illustrate variation in the outlet temperature of the heat medium. In FIG. 3, during cooling, a flow rate of the heat medium (cold water) decreases as a flow path resistance value of an air passage increases. This is because, in the case of heat exchange with the same amount of indoor air, the temperature of the heat medium (cold water) increases as the amount of the heat medium (cold water) decreases. Thus, the outlet temperature of the heat medium increases as the flow path resistance value increases, and the outlet temperature of the heat medium increases as the degree of opening of the flow rate control valve is reduced.

In addition, outlet temperature Tout decreases as inlet temperature Tin decreases, and outlet temperature Tout increases as inlet temperature Tin increases.

During cooling, indoor air having a higher temperature than the heat medium exchanges heat with the heat medium, and therefore, the amount of heat exchange increases and outlet temperature Tout increases as the air volume of the fan increases.

Although not shown, during heating, outlet temperature Tout decreases as inlet temperature Tin decreases, and outlet temperature Tout increases as inlet temperature Tin increases. This applies to both heating and cooling.

During heating, however, the outlet temperature of the heat medium decreases as the flow path resistance value increases. Thus, the outlet temperature of the heat medium decreases as the degree of opening of the flow rate control valve is reduced.

During heating, indoor air having a lower temperature than the heat medium exchanges heat with the heat medium, and therefore, the amount of heat exchange increases and outlet temperature Tout decreases as the air volume of the fan increases.

Normally, heat source device 1 is controlled such that temperature Tin at the inlet from temperature sensor 7 is constant. As described above, as the degree of opening of the flow rate control valve is reduced, an anticipated value (expected temperature) Tj of the outlet water temperature increases during cooling, and expected temperature Tj decreases during heating. Such relation between the degree of opening of flow rate control valve 4 and outlet temperature Tout is learned in advance.

Expected temperature Tj increases as the air volume of the fan increases during cooling, and expected temperature Tj decreases as the air volume of the fan increases during heating. In the case of an indoor unit including a fan having a variable rotation speed, the tendency of expected temperature Tj of outlet temperature Tout relative to the fan rotation speed is also learned in advance.

By focusing on outlet temperature Tout, it can be determined whether the failure is on a water passage side or on an air passage side, as described below.

Figure 4:
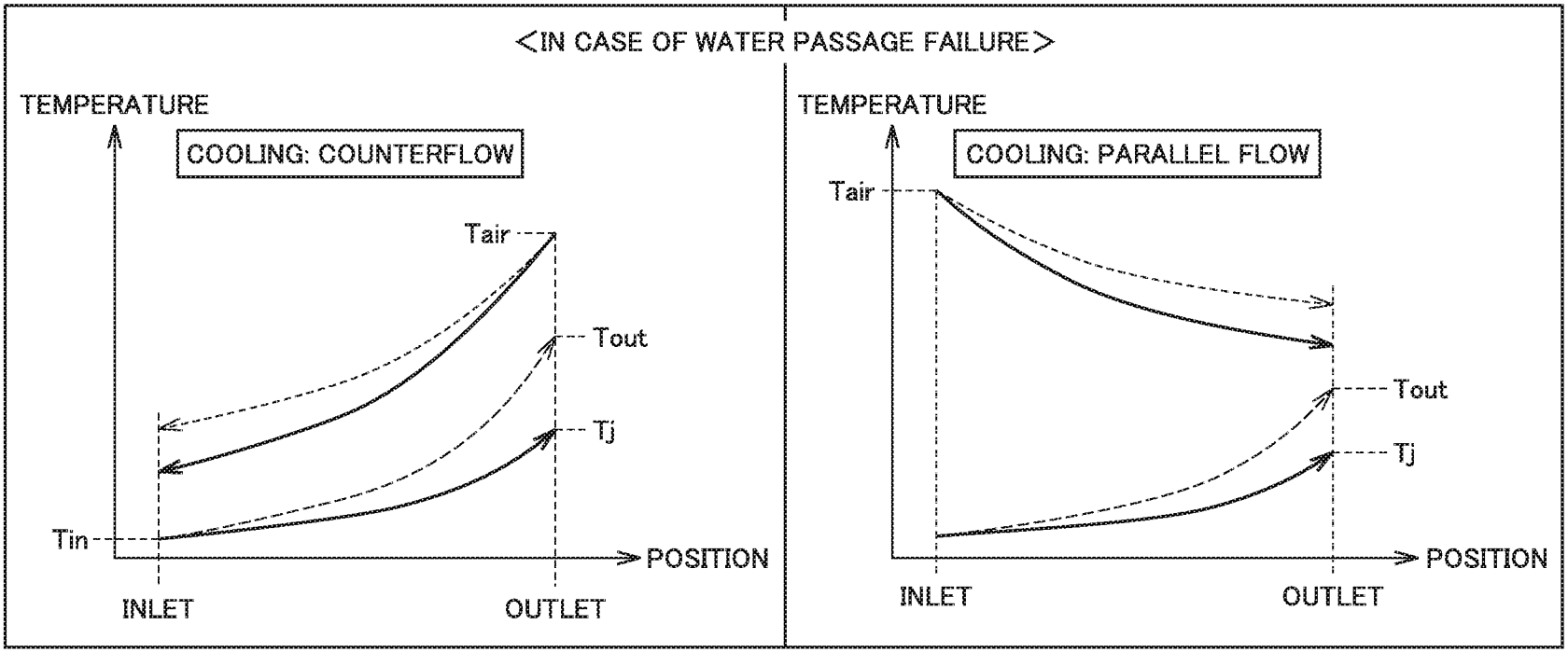
FIG. 4 is a diagram to illustrate how water temperature and air temperature vary in the case of a failure in a water passage.

FIG. 4 is a diagram to illustrate how water temperature and air temperature vary in the case of a failure in a water passage. Examples of failures in the water passage include leakage of the heat medium and pipe clogging. FIG. 4 represents a position at which the temperature is measured on the horizontal axis, and a detected temperature at the measurement position on the vertical axis. Each solid line represents an expected temperature of the heat medium (water) or air at a normal time, and each broken line represents a detected temperature of the heat medium (water) or air upon occurrence of a failure in the water passage.

Leakage of the heat medium causes formation of bubbles in the water passage, and increased resistance at flow rate control valve 4, resulting in a reduced flow rate of the heat medium flowing to the indoor unit.

In the case of cooling, due to the reduced flow rate of the heat medium, detected temperature Tout from temperature sensor 8 rises above expected temperature Tj of the outlet water temperature in a normal state (this is reversed for heating) without the formation of bubbles. In either case where the air and the heat medium are in counterflow or in parallel flow, Tout>Tj is satisfied in the case of a failure in the water passage. A temperature having a margin with respect to expected temperature Tj is set as a determination temperature TjU (upper limit value), and during cooling operation, when temperature Tout detected by temperature sensor 8 is higher than determination temperature TjU, failure determination unit 110 determines that there is an abnormality in the water passage.

Figure 5:
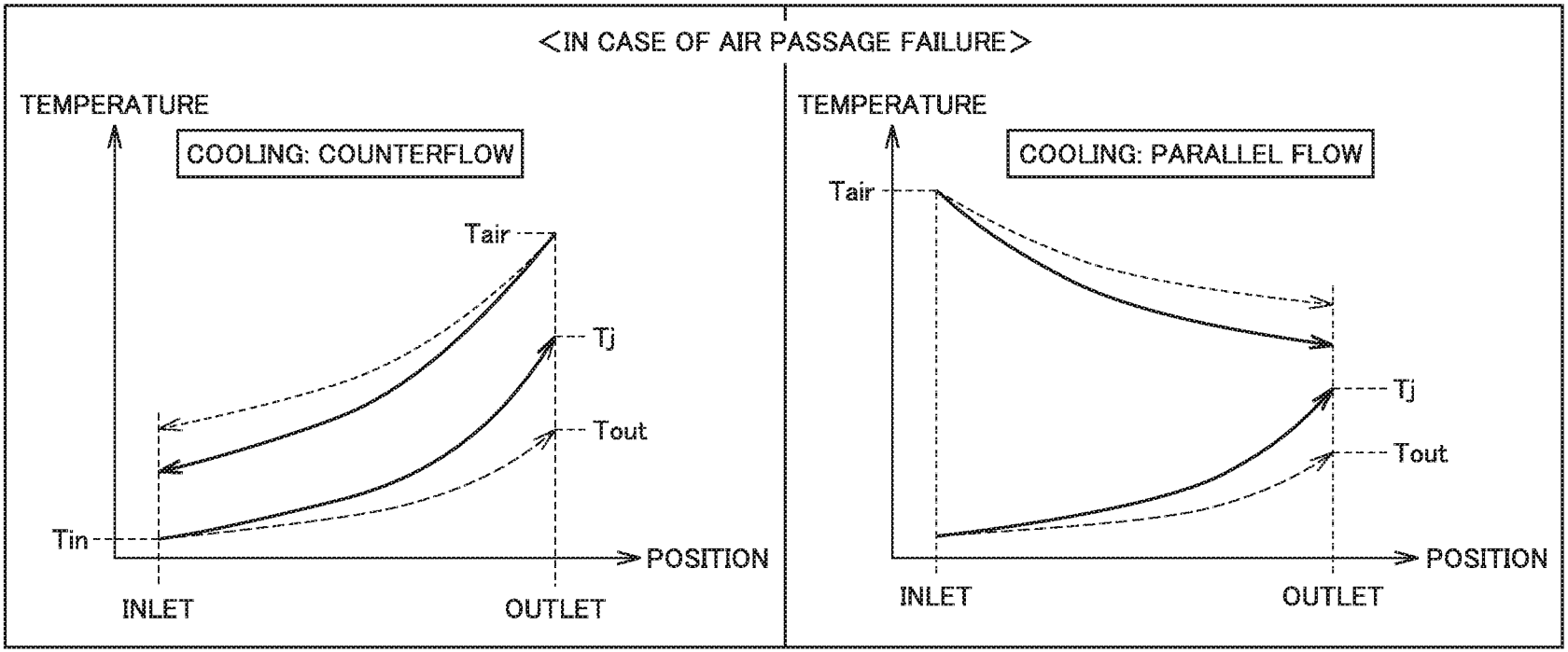
FIG. 5 is a diagram to illustrate how water temperature and air temperature vary in the case of a failure in an air passage.

FIG. 5 is a diagram to illustrate how water temperature and air temperature vary in the case of a failure in an air passage. Examples of failures in the air passage include a failure in the fan, clogging of a fin of the heat exchanger, and corrosion of the fin of the heat exchanger.

In the case of a failure in the air passage, reduced efficiency of heat exchange causes detected temperature Tout to fall below expected temperature Tj of the outlet water temperature in a non-failed state (this is reversed for heating). In either case where the air and the heat medium are in counterflow or in parallel flow, Tout<Tj is satisfied in the case of a failure in the air passage. A temperature having a margin with respect to expected temperature Tj is set as a determination temperature TjL (lower limit value), and during cooling operation, when temperature Tout detected by temperature sensor 8 is lower than determination temperature TjL, failure determination unit 110 determines that there is an abnormality in the air passage.

FIG. 6 shows types of failures, and relation between outlet water temperature Tout and expected temperature Tj (during cooling). Referring to FIGS. 1 and 6, when Tj<Tout is satisfied during cooling operation, it can be determined that there is a failure in the water passage (there is leakage of the heat medium from a pipe or a failure in the flow rate control valve). A temperature having a margin with respect to expected temperature Tj is set as determination temperature TjU (upper limit value), and when temperature Tout detected by temperature sensor 8 is higher than determination temperature TjU, failure determination unit 110 determines that there is an abnormality in the flow path of the heat medium.

A temperature having a margin with respect to expected temperature Tj is set as determination temperature TjL (lower limit value), and during heating operation, when temperature Tout detected by temperature sensor 8 is lower than determination temperature TjL, failure determination unit 110 determines that there is an abnormality in the flow path of the heat medium.

When the failure is detected in all of the indoor units, and Tj<Tout is satisfied during cooling operation, the failure is believed to be leakage (or clogging) of the heat medium from a main pipe (pipes P3 and P5 in FIG. 1).

When the failure is not detected in all of the indoor units, the failure is not believed to be clogging or leakage in the main pipe (pipes P3 and P5 in FIG. 1). When Tj<Tout is satisfied in this case, the failure is leakage of a liquid medium in a branch pipe (pipe P4), or a failure in flow rate control valve 4. When temperature Tout is higher than determination temperature TjU, failure determination unit 110 determines that flow rate control valve 4 has failed, or the heat medium has leaked from pipe P3 or P4 or heat exchanger 3.

When Tj>Tout is satisfied during cooling operation, on the other hand, it can be determined that there is a failure in the air passage (there is a failure of reduced air volume of the fan or reduced efficiency of heat exchange due to clogging with dust or corrosion of the fin).

In the case of a failure in the fan motor, since the presence or absence of the failure can be detected also by a motor current, it can be determined whether the failure is a fan failure or fin clogging by combining determinations with motor current values. When the motor current value is outside a current normal determination range, and temperature Tout detected by temperature sensor 8 is lower than second determination temperature TjL having a margin with respect to expected temperature Tj, failure determination unit 110 determines that fan motor 10 has failed. When the current value of fan motor 10 is inside the current normal determination range, and temperature Tout detected by temperature sensor 8 is lower than second determination temperature TjL, failure determination unit 110 determines that air flow resistance in a fin portion of heat exchanger 3 has increased.

Note that during heating operation, when the motor current value is outside the current normal determination range, and temperature Tout detected by temperature sensor 8 is higher than determination temperature TjU having a margin with respect to expected temperature Tj, failure determination unit 110 determines that fan motor 10 has failed. When the current value of fan motor 10 is inside the current normal determination range, and temperature Tout detected by temperature sensor 8 is higher than determination temperature TjU, failure determination unit 110 determines that air flow resistance in the fin portion of heat exchanger 3 has increased.

Figure 7:
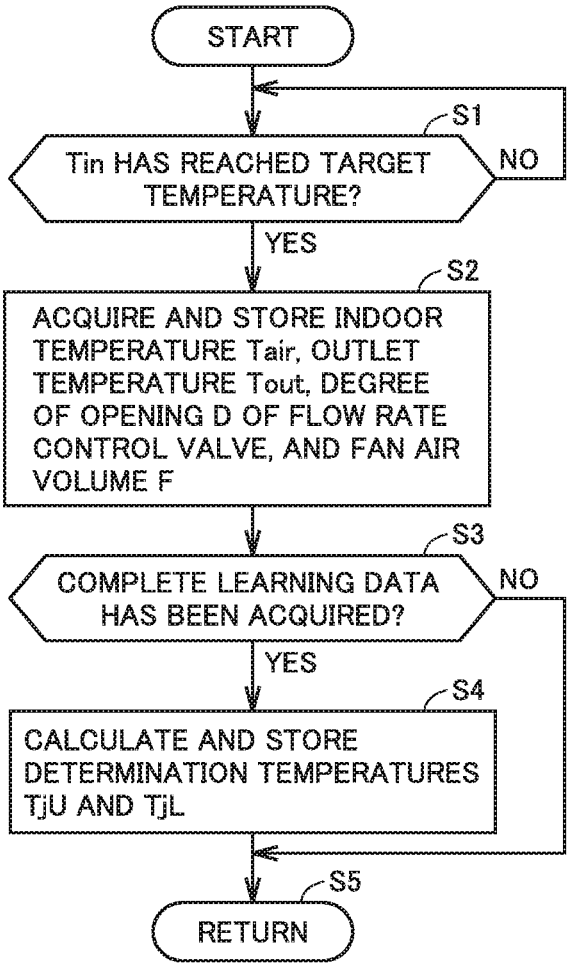
FIG. 7 is a flowchart to illustrate a process of learning a determination value performed by the failure determination unit.

FIG. 7 is a flowchart to illustrate a process of learning the determination value performed by the failure determination unit. The process of this flowchart is performed in order to learn the determination value during a certain period of time immediately after installation when it is assumed that a failure has not yet occurred. First, in step S1, failure determination unit 110 waits until detected temperature Tin of the heat medium at the inlet reaches a target temperature.

When detected temperature Tin reaches the target temperature (YES in S1), in step S2, failure determination unit 110 acquires indoor temperature Tair, outlet temperature Tout, degree of opening D of flow rate control valve 4, and a fan air volume F, and stores them in memory 120.

Then, in step S3, failure determination unit 110 determines whether or not complete learning data has been acquired. It is determined that the complete learning data has been acquired when, for example, data could be acquired a plurality of times at the same indoor temperature. When it is determined that the complete learning data has not been acquired (NO in S3), the process is moved in step S5 from the learning process to a main routine of a normal air-conditioning process. In this case, the acquisition of the learning data in S1 to S2 is performed also during the next operation.

When the complete learning data has been acquired (YES in S3), on the other hand, in step S4, failure determination unit 110 calculates determination temperature TjU (upper limit value) and determination temperature TjL (lower limit value) having upward and downward margins with respect to expected temperature Tj, respectively, and stores them in memory 120.

Figure 8:
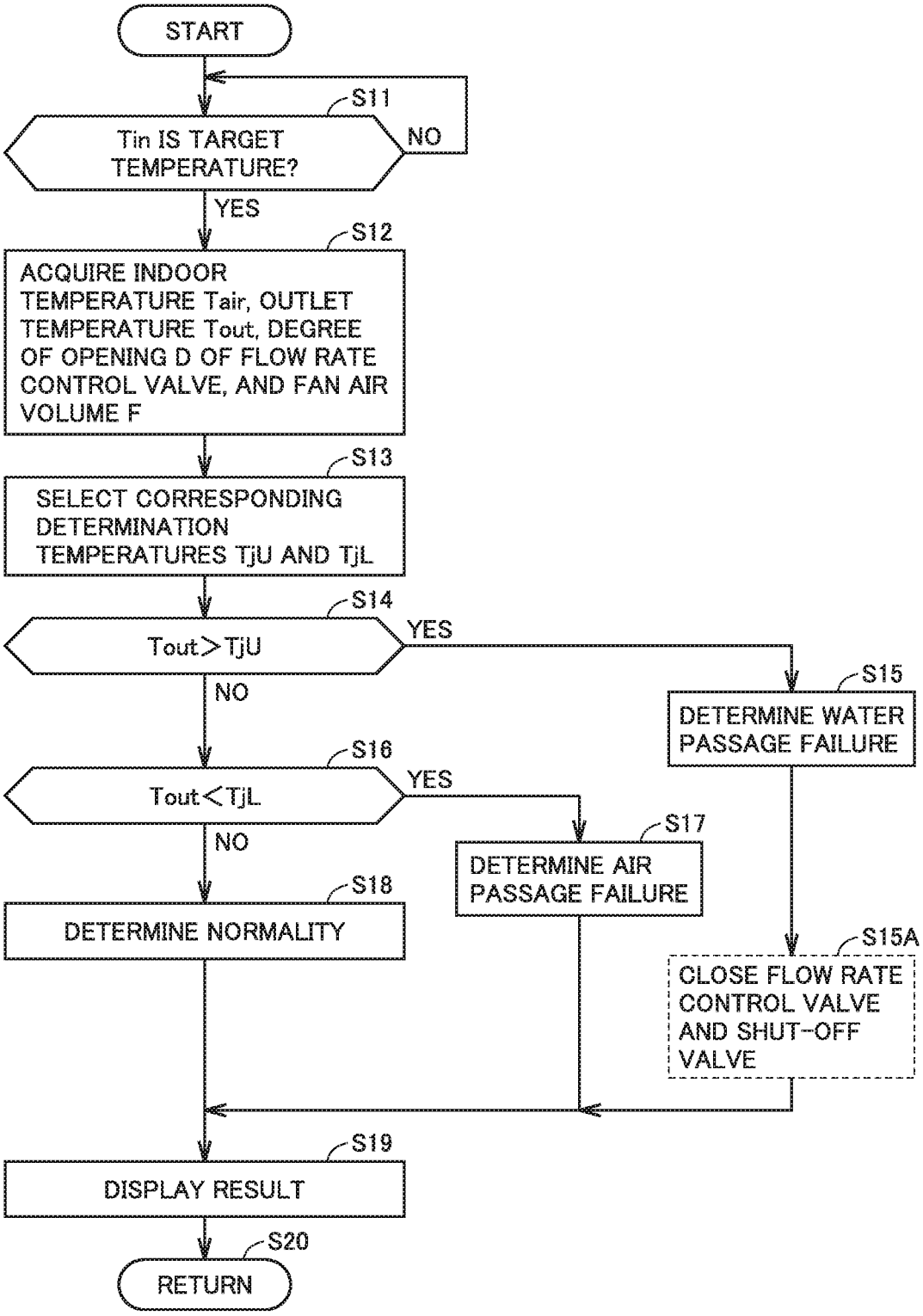
FIG. 8 is a flowchart to illustrate a determination process performed by the failure determination unit.

FIG. 8 is a flowchart to illustrate a determination process (during cooling) performed by the failure determination unit. The process of this flowchart is invoked from the main routine of the air-conditioning operation and performed each time the operation of the air conditioning apparatus is started or after a diagnosis instruction is accepted, after the learning process has been completed.

First, in step S11, failure determination unit 110 determines whether or not detected temperature Tin at the inlet portion is the target temperature. When detected temperature Tin is not stable at the target temperature, outlet temperature Tout also varies as was shown in FIG. 3, and is thus not suitable for a failure determination. Accordingly, failure determination unit 110 waits until temperature Tin is stable at the target temperature.

When detected temperature Tin is the target temperature (YES in S11), in step S12, failure determination unit 110 acquires indoor temperature Tair, outlet temperature Tout, degree of opening D of flow rate control valve 4, and fan air volume F. Then in step S13, the failure determination unit selects determination temperatures TjU and TjL corresponding to the acquired data.

Subsequently, in step S14, failure determination unit 110 determines whether or not Tout>TjU is satisfied. When Tout>TjU is satisfied (YES in S14), in step S15, failure determination unit 110 determines that there is a failure in the water passage.

When Tout>TjU is not satisfied (NO in S14), in step S16, failure determination unit 110 determines whether or not Tout<TjL is satisfied. When Tout<TjL is satisfied (YES in S16), in step S17, failure determination unit 110 determines that there is a failure in the air passage.

When Tout<TjL is not satisfied (NO in S16), on the other hand, outlet temperature Tout falls between upper limit value TjU and lower limit value TjL. In this case, in step S17, failure determination unit 110 determines that the indoor unit is normal.

After any of the determinations in steps S15, S17 and S18 is made, failure determination unit 110 causes display 101 to display the determination result in step S19, and returns the process to the main routine in step S20.

As described above, the air conditioning apparatus in the first embodiment can determine the presence or absence of a failure in the water passage of the indoor unit by monitoring outlet temperature Tout. In addition, the air conditioning apparatus can determine whether the failure is in the water passage of the indoor unit or in the air passage of the indoor unit. Displaying a diagnosis result thus obtained at the display can help repair the failure when it occurs.

(Variation)

Figure 9:
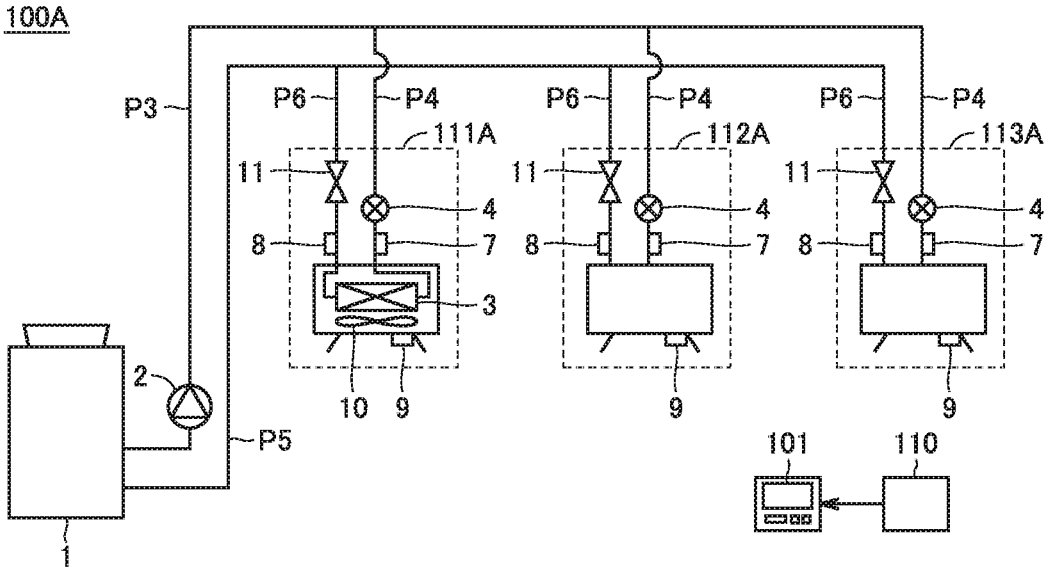
FIG. 9 shows the configuration of an air conditioning apparatus in a variation of the first embodiment.

FIG. 9 shows the configuration of an air conditioning apparatus in a variation of the first embodiment. As shown in FIG. 9, an air conditioning apparatus 100A further includes, in addition to the configuration of air conditioning apparatus 100 shown in FIG. 1, a shut-off valve 11 provided on sixth pipe P6 in each of indoor units 111A to 113A for switching between passage and interruption of the heat medium. When failure determination unit 110 determines that the heat medium has leaked from heat exchanger 3, failure determination unit 110 sets shut-off valve 11 and flow rate control valve 4 corresponding to an indoor unit where the failure has occurred to an interrupting state.

In this case, in the flowchart of FIG. 8, failure determination unit 110 performs the process from S11 to S15 for each indoor unit, and when it is determined that there is a failure in the water passage in step S15, failure determination unit 110 subsequently closes shut-off valve 11 and flow rate control valve 4 corresponding to an indoor unit where the failure has occurred in step S15A, to separate the failed indoor unit from the main pipe (pipes P3 and P5), thereby partially stopping the water flow.

By providing shut-off valve 11 in this manner, it is possible to maintain the operation of a non-failed indoor unit without the need to stop the operation of all indoor units in the case of leakage of the heat medium, thereby preventing a decrease in comfort level.

Second Embodiment

Although the determination value is determined by the learning process in the first embodiment, a condition suitable for learning is not necessarily satisfied immediately, and a certain length of time may be needed to determine the determination value. It is also possible that a diagnosis mode is performed before learning, and a diagnosis result must be displayed.

In the second embodiment, a failure is detected without learning. Note that the assumption is that each indoor unit includes a fan, and the fan has not failed. Since a failure in a fan motor can be detected by a current, it is checked before a diagnosis that the fan motor has not failed by a detected value from current sensor 102.

Figure 10:
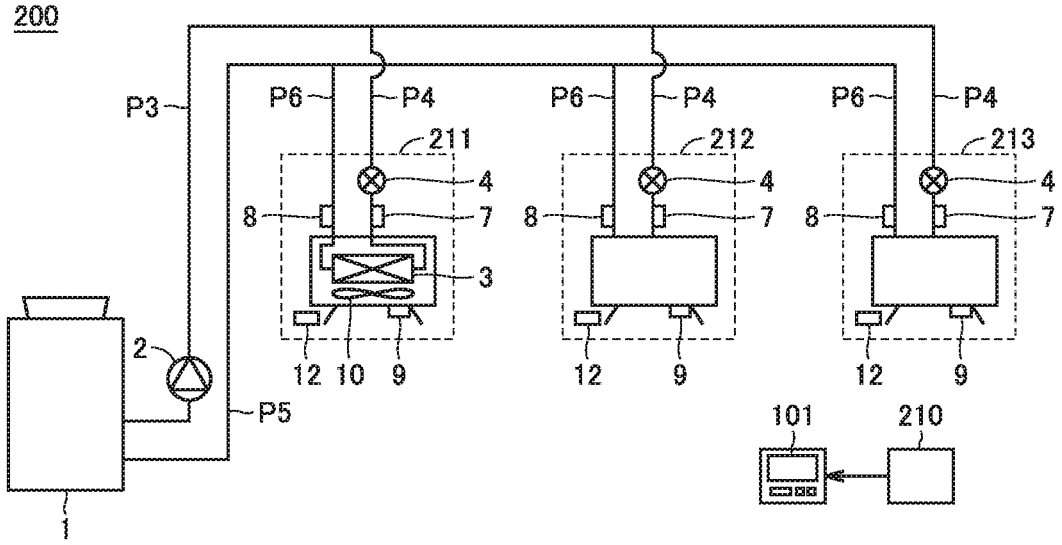
FIG. 10 shows the configuration of an air conditioning apparatus according to a second embodiment.
Figure 11:
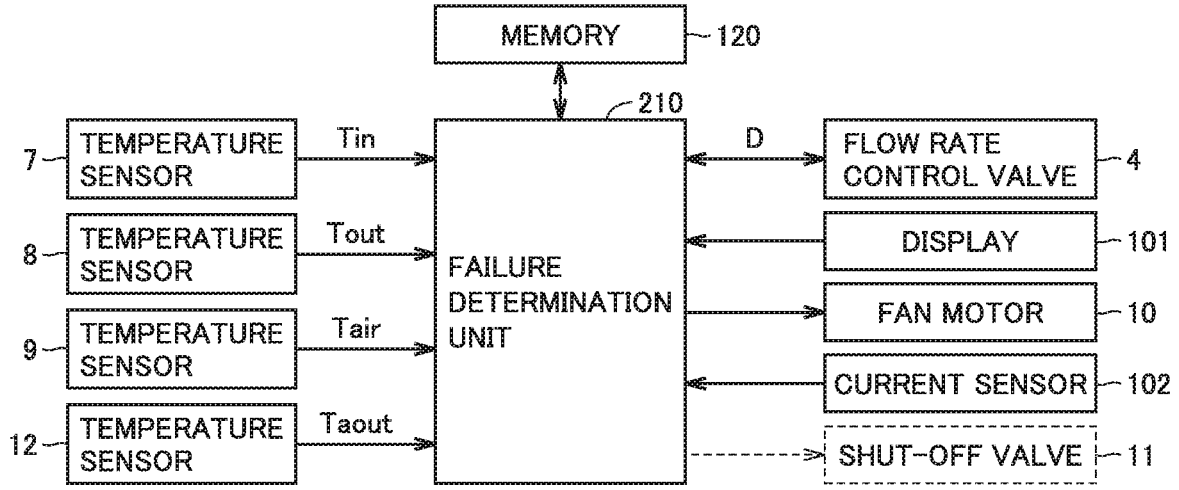
FIG. 11 shows connection relation between a failure determination unit and various sensors and actuators in the second embodiment.

FIG. 10 shows the configuration of an air conditioning apparatus according to the second embodiment. FIG. 11 shows connection relation between a failure determination unit and various sensors and actuators in the second embodiment.

Referring to FIGS. 10 and 11, an air conditioning apparatus 200 includes, in the configuration of air conditioning apparatus 100 shown in FIG. 1, indoor units 211 to 213 in place of indoor units 111 to 113, and a failure determination unit 210 in place of failure determination unit 110.

Indoor units 211 to 213 each further include a temperature sensor 12 for detecting a blown-air temperature Taout in the configurations of indoor units 111 to 113 shown in FIG. 1.

Failure determination unit 210 expects an air-conditioning load in the room in the following equation (1) in the case of cooling:

$$(\text{Tair}-\text{Taout})\times\text{Fan air volume} \quad (1)$$

Failure determination unit 210 expects an air-conditioning load in the room in the following equation (2) in the case of heating:

$$(\text{Taout}-\text{Tair})\times\text{Fan air volume} \quad (2)$$

Note that by studying in advance the relation between a value indicating a driven state of the fan, such as rotation speed or fan motor current value, and the air volume, failure determination unit 210 can obtain a fan air volume in a manner corresponding to the driven state of the fan.

Relation between the air-conditioning load and the outlet water temperature at a normal time is stored in memory 120 in advance. When outlet water temperature Tout measured by temperature sensor 8 does not match the outlet water temperature at a normal time corresponding to the calculated air-conditioning load in the room, failure determination unit 210 causes display 101 to display a failure.

Figure 12:
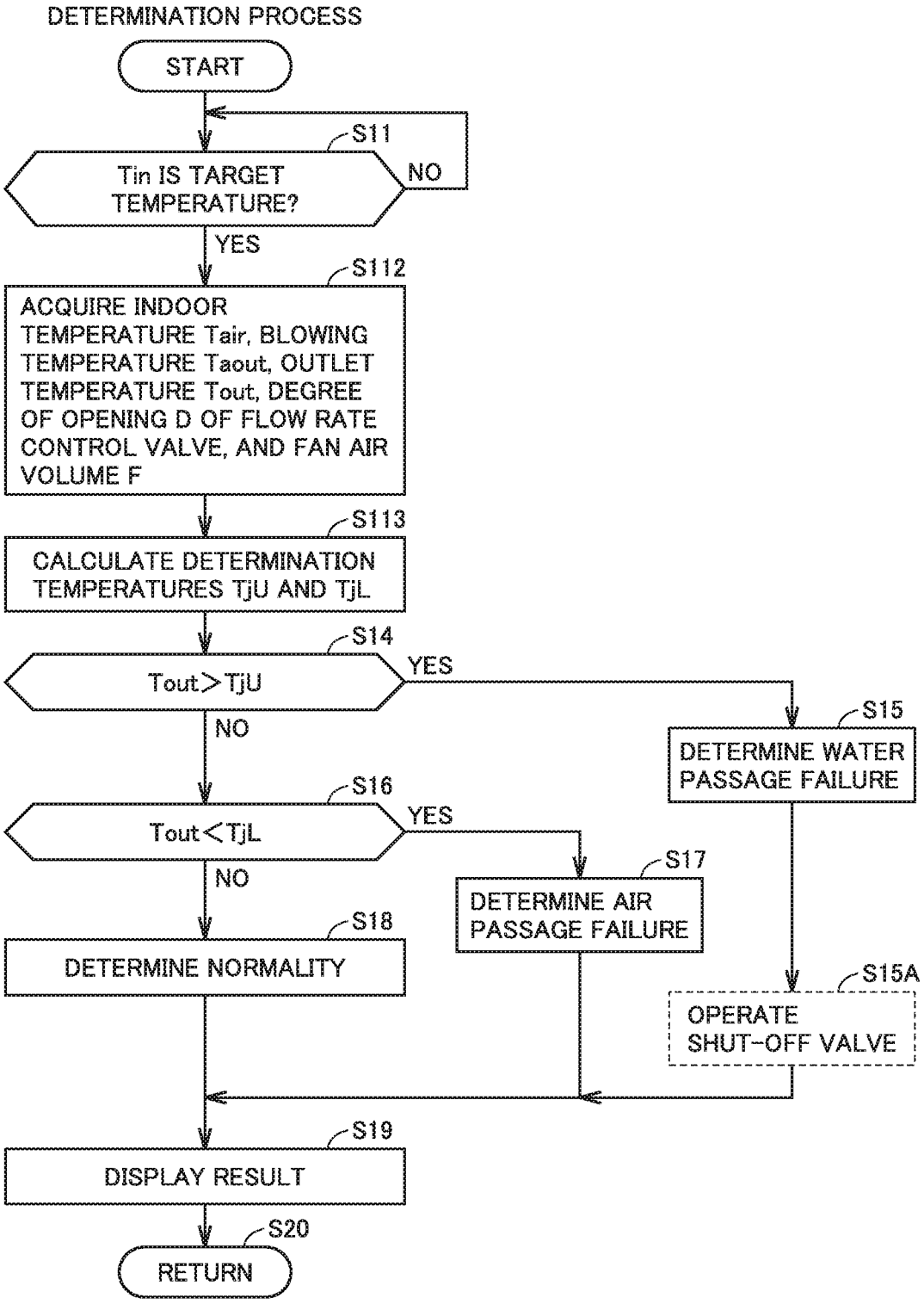
FIG. 12 is a flowchart to illustrate a diagnosis process performed by the failure determination unit in the second embodiment.

FIG. 12 is a flowchart to illustrate a diagnosis process performed by the failure determination unit in the second embodiment. In the flowchart shown in FIG. 12, step S112 and step S113 are performed in place of step S12 and step S13 in the process of the flowchart performed in the first embodiment shown in FIG. 8.

In step S112, failure determination unit 210 acquires indoor temperature Tair, blowing temperature Taout, outlet temperature Tout, degree of opening D of flow rate control valve 4, and fan air volume F. Then in step S113, the failure determination unit calculates determination temperatures TjU and TjL corresponding to the acquired data. Failure determination unit 210 calculates determination temperature TjU (upper limit value) and determination temperature TjL (lower limit value) having upward and downward margins with respect to temperature Tj, respectively, which was calculated based on the equation (1) or the equation (2) described above.

Subsequently, the process from steps S14 to S19 is performed using calculated determination temperature TjU (upper limit value) and determination temperature TjL (lower limit value), as in the first embodiment.

In this manner, a failure determination can be made without using a learning process in the second embodiment. Thus, the air conditioning apparatus in the second embodiment can further make a failure diagnosis immediately after installation, in addition to providing the effect of the air conditioning apparatus in the first embodiment.

(Variation)

Figure 13:
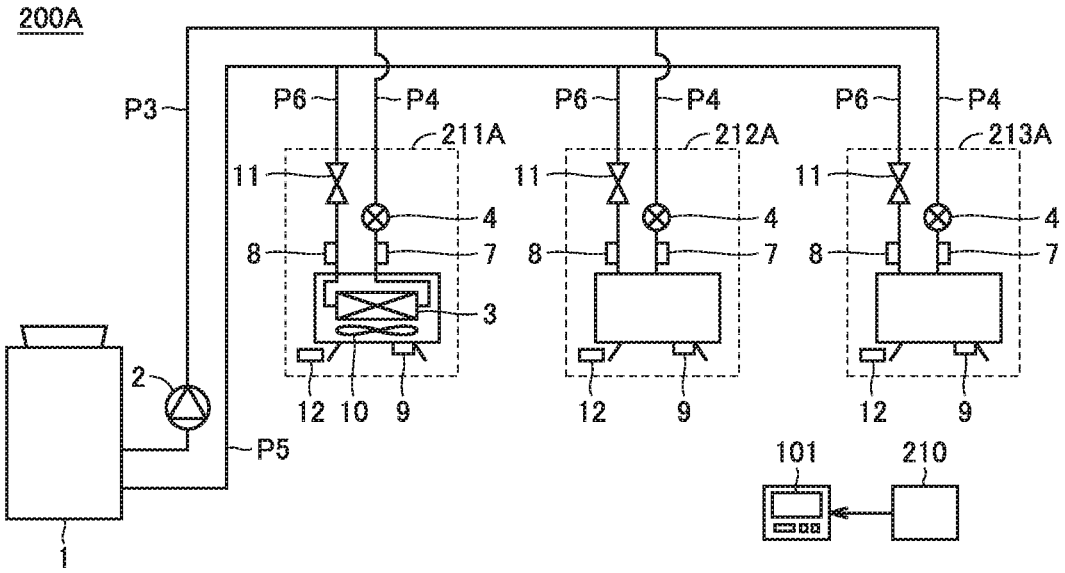
FIG. 13 shows the configuration of an air conditioning apparatus in a variation of the second embodiment.

FIG. 13 shows the configuration of an air conditioning apparatus in a variation of the second embodiment. As shown in FIG. 13, an air conditioning apparatus 200A includes, in addition to the configuration of air conditioning apparatus 200 shown in FIG. 10, indoor units 211A to 213A in place of indoor units 211 to 213.

Indoor units 211A to 213A each further include shut-off valve 11 provided on sixth pipe P6 for switching between passage and interruption of the heat medium, in the configurations of indoor units 211 to 213. When failure determination unit 210 determines that the heat medium has leaked from heat exchanger 3, failure determination unit 210 sets shut-off valve 11 and flow rate control valve 4 corresponding to an indoor unit where the failure has occurred to an interrupting state.

In this case, in the flowchart of FIG. 12, failure determination unit 210 performs the process of S11, S112, S113, S14 and S15 for each indoor unit, and when it is determined that there is a failure in the water passage in step S15, failure determination unit 210 subsequently closes shut-off valve 11 and flow rate control valve 4 corresponding to an indoor unit where the failure has occurred in step S15A, to partially stop the water flow. Note that when the heat medium leaks in a plurality of indoor units, a plurality of branch pipes or the main pipe, shut-off valve 11 and flow rate control valve 4 are closed, and heat source device 1 and a pump 2 are also stopped in coordination, so that the amount of leakage of the heat medium can be suppressed, and a failure in heat source device 1 (such as freezing of the heat medium in the case of heating, and pressure increase due to the stopped water flow in the case of heating) can also be prevented.

By providing shut-off valve 11 in this manner, it is possible to maintain the operation of a non-failed indoor unit without the need to stop the operation of all indoor units being in the case of leakage of the heat medium, thereby preventing a decrease in comfort level.

Third Embodiment

Figure 14:
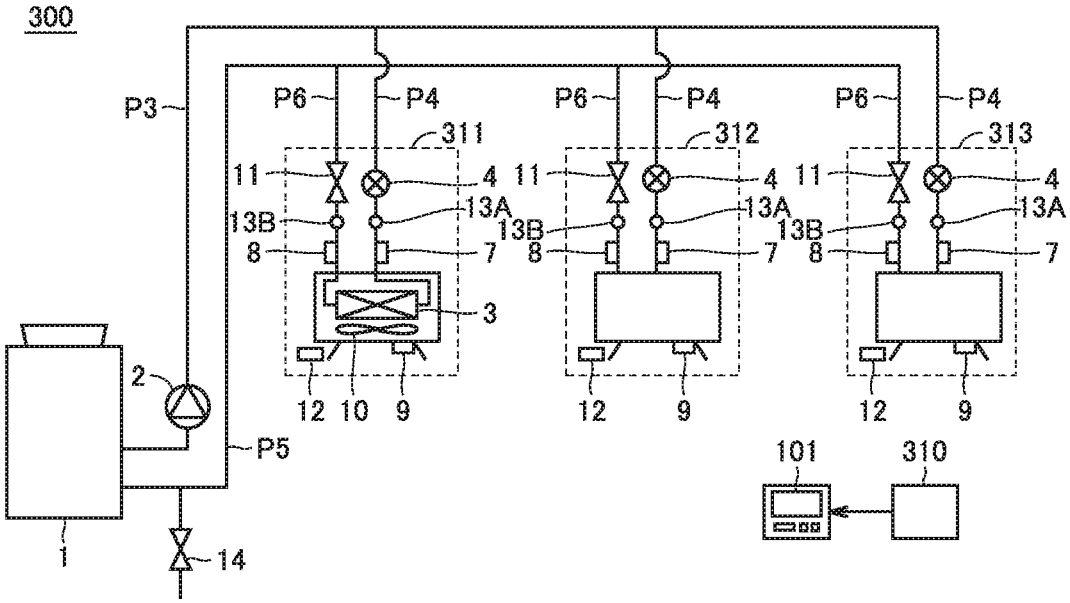
FIG. 14 shows the configuration of an air conditioning apparatus according to a third embodiment.
Figure 15:
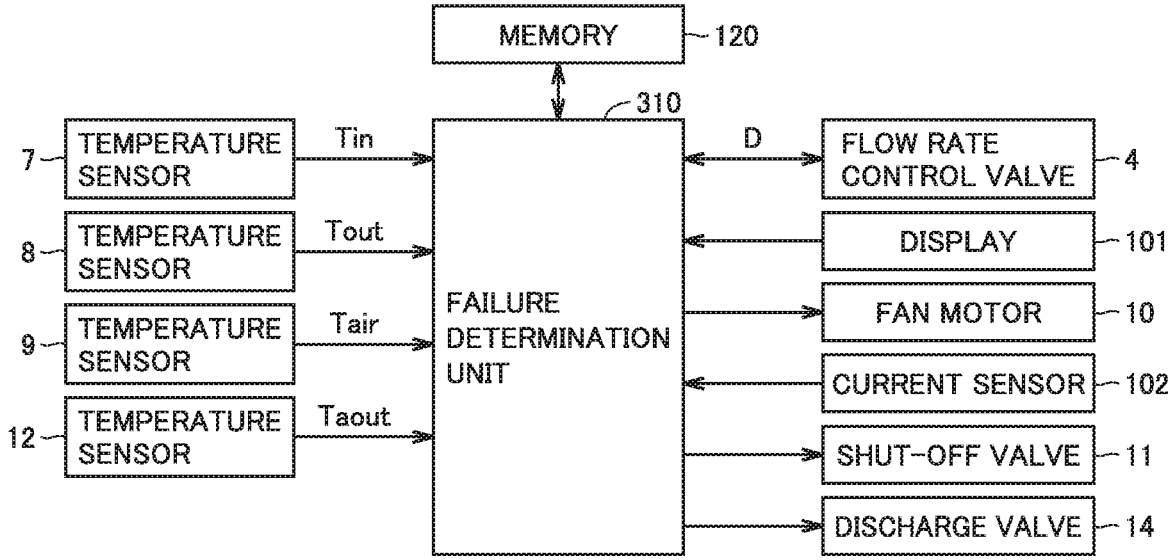
FIG. 15 shows connection relation between a failure determination unit and various sensors and actuators in the third embodiment.

FIG. 14 shows the configuration of an air conditioning apparatus according to a third embodiment. FIG. 15 shows connection relation between a failure determination unit and various sensors and actuators in the third embodiment.

Referring to FIGS. 14 and 15, an air conditioning apparatus 300 includes, in the configuration of air conditioning apparatus 100 shown in FIG. 1, indoor units 311 to 313 in place of indoor units 111 to 113, a failure determination unit 310 in place of failure determination unit 110, and additionally a discharge valve 14.

Indoor units 311 to 313 each further include, in addition to the configuration of each of indoor units 111 to 113, a flow rate sensor 13A provided on fourth pipe P4, and shut-off valve 11 and a flow rate sensor 13B provided on sixth pipe P6. Shut-off valve 11 switches between passage and interruption of the heat medium. Flow rate sensor 13A detects a flow rate of the heat medium passing through fourth pipe P4. Flow rate sensor 13B detects a flow rate of the heat medium passing through sixth pipe P6. When temperature Tout is higher than determination temperature TjU during cooling, and the flow rate detected by flow rate sensor 13B is lower than the flow rate detected by flow rate sensor 13A, failure determination unit 310 determines that the heat medium has leaked from pipe P4 or heat exchanger 3.

When failure determination unit 310 detects the leakage of the heat medium from pipe P4 or heat exchanger 3 in one of indoor units 311 to 313, failure determination unit 310 closes flow rate control valve 4 and shut-off valve 11 corresponding to the indoor unit where the leakage has been detected.

When the failure determination unit detects the leakage of the heat medium in more than one of indoor units 311 to 313, the failure determination unit stops the operation of heat source device 1 and pump 2, and opens discharge valve 14.

Figure 16:
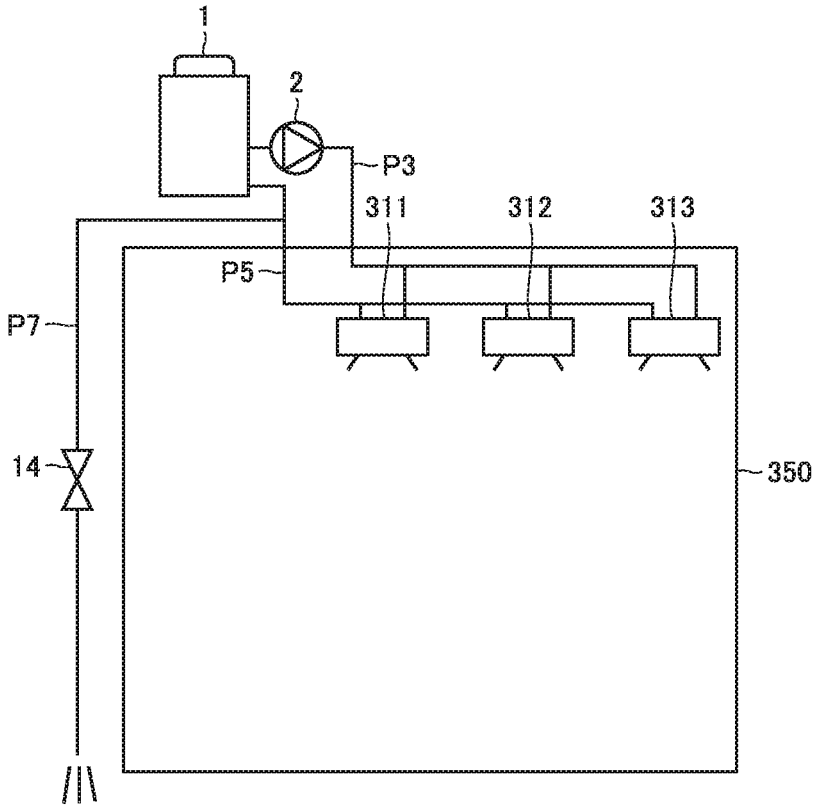
FIG. 16 shows a first example of arrangement of a discharge valve.
Figure 17:
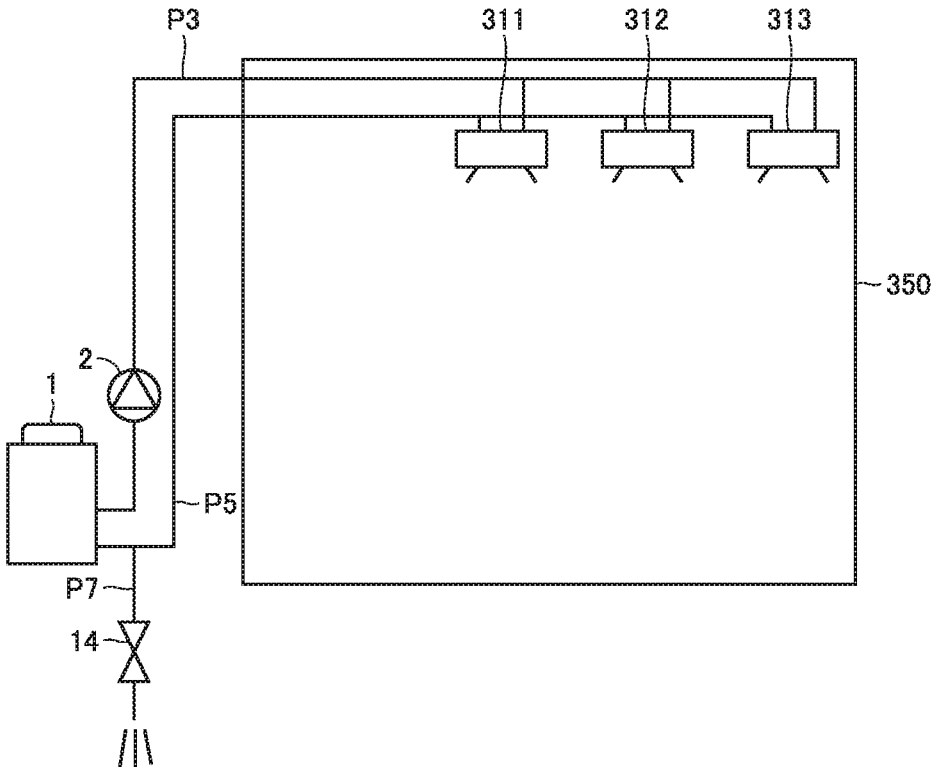
FIG. 17 shows a second example of arrangement of the discharge valve.

FIG. 16 shows a first example of arrangement of the discharge valve. FIG. 17 shows a second example of arrangement of the discharge valve.

As shown in FIG. 16, when indoor units 311 to 313 are installed on a ceiling portion of a building 350, and heat source device 1 is arranged on a rooftop of building 350, discharge valve 14 is provided on a portion of a pipe P7 branching from pipe P5, at a position lower than indoor units 311 to 313. From discharge valve 14, the heat medium will be discharged to a water drainage channel, for example.

As shown in FIG. 17, when indoor units 311 to 313 are installed on the ceiling portion of building 350, and heat source device 1 is arranged on a ground section outside building 350, discharge valve 14 is provided at the tip of pipe P7 branching from pipe P5 to a position lower than heat source device 1. Note that the arrangement of FIG. 17 requires shorter pipe P7 than in FIG. 16.

Air conditioning apparatus 300 in the third embodiment further includes pipe P7 and discharge valve 14. Pipe P7 is connected to pipe P3 or pipe P5. Discharge valve 14 is provided on pipe P7 at a position lower than all of heat source device 1, heat exchanger 3, third pipe P3, and fifth pipe P5. Discharge valve 14 switches between passage and interruption of the heat medium through pipe P7. When failure determination unit 310 determines that the heat medium has leaked from pipe P4 or heat exchanger 3 in a plurality of indoor units, failure determination unit 310 sets discharge valve 14 to a passing state, and stops pump 2. The heat medium fills the space ending at discharge valve 14 while discharge valve 14 is closed. When discharge valve 14 is opened, the heat medium in indoor units 311 to 313, heat source device 1 and the pipes is discharged according to the siphon principle. By providing discharge valve 14 at such positions, the heat medium is discharged by gravity when pump 2 is stopped.

Air conditioning apparatus 300 in the third embodiment includes flow rate sensor 13A for detecting a flow rate of the heat medium flowing into heat exchanger 3, and flow rate sensor 13B for detecting a flow rate of the heat medium that has passed through flow rate control valve 4 and heat exchanger 3. When temperature Tout is higher than determination temperature TjU (during cooling), and the flow rate out of heat exchanger 3 is lower than the flow rate into heat exchanger 3, failure determination unit 310 determines that the heat medium has leaked from fourth pipe P4 or heat exchanger 3. By detecting a reduction in the flow rate by flow rate sensors 13A and 13B, the leakage of the heat medium can be reliably detected.

Figure 18:
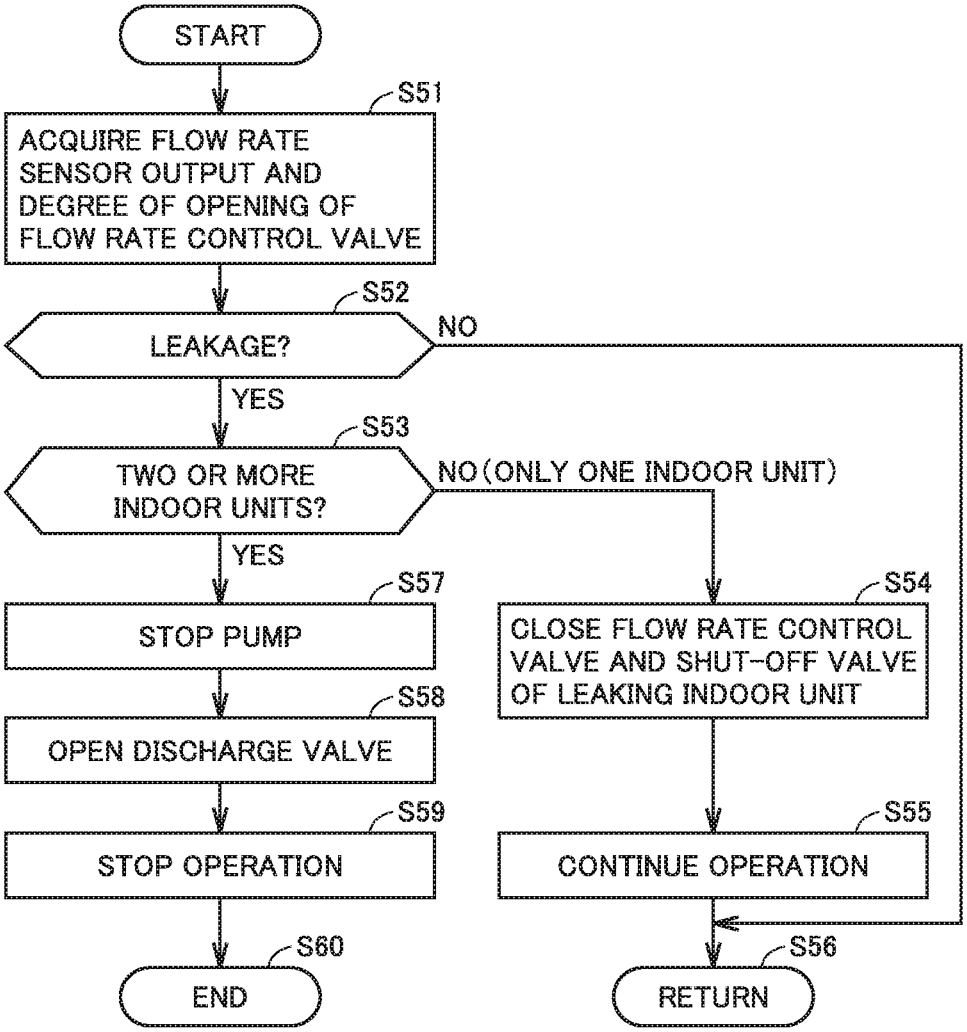
FIG. 18 is a flowchart to illustrate a diagnosis process performed by the failure determination unit in the third embodiment.

FIG. 18 is a flowchart to illustrate a diagnosis process performed by the failure determination unit in the third embodiment. Referring to FIGS. 14 and 18, in step S51, air conditioning apparatus 300 in the third embodiment acquires outputs from flow rate sensors 13 and the degree of opening of flow rate control valve 4 in each of indoor units 311 to 313. Relation between the degree of opening of flow rate control valve 4 and the flow rate without leakage of the heat medium is stored in memory 120 in advance.

Then in step S52, failure determination unit 310 compares the flow rate detected by flow rate sensor 13A and the flow rate detected by flow rate sensor 13B, to determine whether or not there is leakage of the heat medium. When the flow rate detected by flow rate sensor 13B is lower than the flow rate detected by flow rate sensor 13A, it can be determined that leakage of the heat medium has occurred in heat exchanger 3.

When there is no leakage of the heat medium from any indoor unit in step S52, the process proceeds from step S52 to step S56.

When it is determined that there is leakage of the heat medium from one of the indoor units in step S52 (YES in S52), in step S53, it is determined whether or not the leakage has occurred in two or more indoor units.

When the leakage has not occurred in two or more indoor units (when there is one leaking indoor unit) in step S53, flow rate control valve 4 and shut-off valve 11 of the leaking indoor unit are closed in step S54, and the operation of non-leaking indoor units is continued in step S55.

When the leakage has occurred in two or more indoor units in step S53, on the other hand, pump 2 is stopped in step S57, and discharge valve 14 is opened in step S58 to discharge the heat medium in the circulation path, in order to prevent the spread of the leakage of the heat medium into the room. Then, the operation of air conditioning apparatus 300 is stopped in step S59, and the process ends in step S60.

Although it was determined whether or not the leakage has occurred in two or more indoor units in step S53, the determination value of the number of leaking indoor units may be changed as appropriate. For example, if there is even a single indoor unit operating normally, the operation may be continued in steps S54 and S55.

By providing shut-off valve 11 for each indoor unit as described above, there is no need to stop the operation of all indoor units in the case of leakage of the heat medium, so that a decrease in comfort level can be prevented.

When the heat medium leaks in a plurality of indoor units, branch pipes or the main pipe, too, heat source device 1 and a pump 2 are stopped in coordination, so that the amount of leakage of the heat medium can be suppressed, and a failure in heat source device 1 (such as freezing of the heat medium in the case of heating, and pressure increase due to the stopped water flow in the case of heating) can also be prevented.

Further, by providing discharge valve 14, the amount of leakage of the heat medium into the room can be suppressed.

It should be understood that the embodiments disclosed herein are illustrative and non-restrictive in every respect. The scope of the present disclosure is defined by the terms of the claims, rather than the description of the embodiments above, and is intended to include any modifications within the meaning and scope equivalent to the terms of the claims.

The invention claimed is:

1. An air conditioning apparatus using a heat medium containing at least one of cold water and hot water, the air conditioning apparatus comprising:

a heat source device;

a heat exchanger configured to exchange heat between the heat medium and air;

a flow rate control valve configured to control a flow rate at which the heat medium is supplied to the heat exchanger;

a temperature sensor configured to detect a temperature of the heat medium discharged from the heat exchanger;

a failure determination unit configured to detect presence or absence of an abnormality in a flow path of the heat medium based on the temperature detected by the temperature sensor and a commanded degree of opening for the flow rate control valve; and a first pipe configured to deliver the heat medium from the heat source device to the heat exchanger;

a second pipe configured to return the heat medium from the heat exchanger to the heat source device; and a flow rate sensor configured to detect a flow rate of the heat medium flowing into the heat exchanger and a flow rate of the heat medium that has passed through the heat exchanger, wherein when the temperature detected by the temperature sensor is higher than a determination temperature during cooling operation, the failure determination unit is configured to determine that there is an abnormality in the flow path, when the temperature detected by the temperature sensor is higher than the determination temperature during the cooling operation, the failure determination unit is configured to determine that the flow rate control valve has failed, or the heat medium has leaked from the first pipe or the heat exchanger, and when, during the cooling operation, the temperature is higher than the determination temperature, and the flow rate of the heat medium flowing out of the heat exchanger is lower than the flow rate of the heat medium flowing into the heat exchanger, the failure determination unit is configured to determine that the heat medium has leaked from the first pipe or the heat exchanger.

2. The air conditioning apparatus according to claim 1, wherein the first pipe includes a third pipe through which the heat medium delivered from the heat source device to the heat exchanger and another utilized apparatus passes, and a fourth pipe which branches from the third pipe, and through which the heat medium delivered to the heat exchanger passes, the second pipe includes a fifth pipe through which the heat medium returned from the heat exchanger and the another utilized apparatus to the heat source device passes, and a sixth pipe through which the heat medium discharged from the heat exchanger passes, and which joins the fifth pipe, the air conditioning apparatus further comprises a shut-off valve provided on the fourth pipe and configured to switch between passage and interruption of the heat medium, and when the failure determination unit determines that the heat medium has leaked from the first pipe or the heat exchanger, the failure determination unit is configured to set the shut-off valve to an interrupting state.

3. The air conditioning apparatus according to claim 2, wherein when the temperature detected by the temperature sensor is lower than a third determination temperature lower than the determination temperature during heating operation, the failure determination unit is configured to determine that there is an abnormality in the flow path.

4. The air conditioning apparatus according to claim 1, wherein the first pipe includes a third pipe through which the heat medium delivered from the heat source device to the heat exchanger and another utilized apparatus passes, and a fourth pipe which branches from the third pipe, and through which the heat medium delivered to the heat exchanger passes, the second pipe includes a fifth pipe through which the heat medium returned from the heat exchanger and the another utilized apparatus to the heat source device passes, and a sixth pipe through which the heat medium discharged from the heat exchanger passes, and which joins the fifth pipe, the air conditioning apparatus further comprises:

a seventh pipe connected to the third pipe or the fifth pipe, and having a discharge port provided at a position lower than all of the heat source device, the heat exchanger, the third pipe, and the fifth pipe; and a discharge valve provided on the seventh pipe and configured to switch between passage and interruption of the heat medium, and when the failure determination unit determines that the heat medium has leaked from the first pipe or the heat exchanger, the failure determination unit is configured to set the discharge valve to a passing state.

5. The air conditioning apparatus according to claim 4, wherein when the temperature detected by the temperature sensor is lower than a third determination temperature lower than the determination temperature during heating operation, the failure determination unit is configured to determine that there is an abnormality in the flow path.

6. The air conditioning apparatus according to claim 1, wherein when the temperature detected by the temperature sensor is lower than a third determination temperature lower than the determination temperature during heating operation, the failure determination unit is configured to determine that there is an abnormality in the flow path.

7. An air conditioning apparatus using a heat medium containing at least one of cold water and hot water, the air conditioning apparatus comprising:

a heat source device;

a heat exchanger configured to exchange heat between the heat medium and air;

a flow rate control valve configured to control a flow rate at which the heat medium is supplied to the heat exchanger;

a temperature sensor configured to detect a temperature of the heat medium discharged from the heat exchanger; and a failure determination unit configured to detect presence or absence of an abnormality in a flow path of the heat medium based on the temperature detected by the temperature sensor and a commanded degree of opening for the flow rate control valve;

a fan configured to blow air to the heat exchanger; and a current sensor configured to detect a current of a motor configured to drive the fan, wherein when the temperature detected by the temperature sensor is higher than a determination temperature during cooling operation, the failure determination unit is configured to determine that there is an abnormality in the flow path, when a current value of the motor is outside a current normal determination range, and the temperature detected by the temperature sensor is lower than the second determination temperature, the failure determination unit is configured to determine that the motor has failed, and when the current value of the motor is inside the current normal determination range, and the temperature detected by the temperature sensor is lower than the second determination temperature, the failure determination unit is configured to determine that air flow resistance in a fin portion of the heat exchanger has increased.

8. The air conditioning apparatus according to claim 7, wherein when the temperature detected by the temperature sensor is lower than a third determination temperature lower than the determination temperature during heating operation, the failure determination unit is configured to determine that there is an abnormality in the flow path.

9. An air conditioning apparatus using a heat medium containing at least one of cold water and hot water, the air conditioning apparatus comprising:

a heat source device;

a heat exchanger configured to exchange heat between the heat medium and air;

a flow rate control valve configured to control a flow rate at which the heat medium is supplied to the heat exchanger;

a temperature sensor configured to detect a temperature of the heat medium discharged from the heat exchanger; and a failure determination unit configured to detect presence or absence of an abnormality in a flow path of the heat medium based on the temperature detected by the temperature sensor and a commanded degree of opening for the flow rate control valve;

wherein when the temperature detected by the temperature sensor is higher than a determination temperature during cooling operation, the failure determination unit is configured to determine that there is an abnormality in the flow path, when the temperature detected by the temperature sensor is lower than a third determination temperature lower than the determination temperature during heating operation, the failure determination unit is configured to determine that there is an abnormality in the flow path, and when the temperature detected by the temperature sensor is higher than a fourth determination temperature higher than the determination temperature during the heating operation, the failure determination unit is configured to determine that there is an abnormality in the air passage to the heat exchanger.

* * * * *